US005989046A

United States Patent [19]

Togashi

[11] Patent Number: 5,989,046

[45] Date of Patent: Nov. 23, 1999

[54] COAXIAL CONNECTOR WITH SWITCH

[75] Inventor: Koji Togashi, Tokyo, Japan

[73] Assignee: SMK Corporation, Tokyo, Japan

[21] Appl. No.: 09/076,003

[22] Filed: May 12, 1998

[30] Foreign Application Priority Data

May 12, 1997 [JP] Japan ..... 9-120507

[51] Int. Cl.[6] ..... H01R 29/00

[52] U.S. Cl. ..... 439/188; 200/51.09; 439/944

[58] Field of Search ..... 439/188, 944; 200/51.1, 51.09

[56] References Cited

U.S. PATENT DOCUMENTS

| | | | |
|---|---|---|---|
| 4,370,694 | 1/1983 | Hargrave | 200/51.09 |
| 5,085,592 | 2/1992 | Sekiguchi | 439/188 |
| 5,267,871 | 12/1993 | Flanagan | 439/188 |
| 5,580,261 | 12/1996 | Meynier | 439/188 |
| 5,839,910 | 11/1998 | Meller et al. | 439/188 |

FOREIGN PATENT DOCUMENTS 6-223924 8/1994 Japan .

*Primary Examiner*—Khiem Nguyen
*Assistant Examiner*—T C Patel
*Attorney, Agent, or Firm*—Armstrong, Westerman, Hattori, McLeland & Naughton

[57] ABSTRACT

A coaxial connector with a switch has a central terminal, an outer terminal, and a switch terminal. When a plug is inserted in the coaxial connector, the central terminal is connected to the plug central terminal of the plug, while the outer terminal is connected with the plug outer terminal. At this time, the switch terminal comes into contact with the plug outer terminal, and it is electrically connected to the outer terminal via the plug outer terminal. The outer terminal is shaped as a cylindrical shell, and the switch terminal is positioned so as to face the outer terminal. When the plug is inserted, the plug outer terminal is inserted between the outer terminal and the switch terminal, whereby the switch terminal is electrically connected to the outer terminal, and the switch is activated. When the plug is not inserted, the switch terminal is separated from the outer terminal and, accordingly, the switch is not activated.

2 Claims, 4 Drawing Sheets

COAXIAL CONNECTOR WITH SWITCH

BACKGROUND OF THE INVENTION

1. Field of The Invention

This invention generally relates to a coaxial connector with a switch and more particularly, to a coaxial connector that connects a peripheral device (e.g., an external antenna) to a main set (e.g., a cellular phone), wherein the coaxial connector has a switching function for activating an internal circuit (e.g., an antenna switching circuit) of the main set when the peripheral device is connected thereto.

2. Description of The Related Art

When connecting an external antenna to a cellular phone, the transmitting/receiving circuit of the cellular phone needs to be disconnected from its internal antenna, and instead, it must be connected to the external antenna. To this end, a cellular phone has a built-in switching circuit. As a connector for connecting the external antenna to the cellular phone, a coaxial connector with a switch is used. The coaxial connector with the switch activates the antenna switching circuit of the cellular phone when a connection is made.

FIG. 6 illustrates a conventional coaxial connector with a switch (which is also referred to as a receptacle). This coaxial connector has a central terminal 13 which looks like a long leaf spring. An outer terminal 5 and a switch terminal 7, which form the halves of a cylindrical shell divided along a longitudinal axis, surround the central terminal 13. When a plug (that is, a second connector) is inserted in the coaxial connector, the central terminal 13 comes into contact with a central terminal 33 of the plug, while the outer terminal 5 and the switch terminal 7 contact an outer terminal 35 of the plug, whereby the switch terminal 7 is electrically connected to the outer terminal 5 via the outer terminal 35 of the plug. At this time, the coaxial connector functions as a switch. Thus, the coaxial connector is of an electrical switching type.

However, because the outer terminal 5 and the switch terminal 7 are formed as half-shells of a cylinder, the conventional coaxial connector is inferior in high-frequency performance.

FIG. 7 illustrates another example of coaxial connector with a switch, which is of a mechanical switching type and does not require a switching circuit. Because the shape and configuration of the mechanical-switching type coaxial connector differs from the shaped configuration of an electrical-switching type coaxial connector, parts cannot be shared in common between the electrical and mechanical switching type coaxial connectors.

Japanese Patent Application Laid-open No. 6-223924 discloses a coaxial connector with a switch, in which a switch, that comprises both a leaf-spring type movable contact piece and a plate-type fixed contact piece, is provided separately from the connector main body, but is attached to the connector main body. When a plug is inserted into the connector main body, the movable contact piece is pressed against the plug, and is disconnected from the fixed contact piece, thereby functioning as a switch. However, this type of coaxial connector is likely to be large in size and thus, require a larger space for attaching the connector.

SUMMARY OF THE INVENTION

Accordingly, it is an object of the present invention to overcome the problems of the prior art coaxial connectors by providing a compact coaxial connector with a switch having a satisfactory switching function and an excellent high-frequency performance.

In order to achieve the above-stated object, a coaxial connector with a switch, into which a plug is inserted in a removable fashion, is provided. This coaxial connector with a switch comprises: a central terminal, which comes into contact with a central terminal of the plug, when the plug is inserted; an outer terminal, which comes into contact with an outer terminal of the plug, when the plug is inserted; and a switch, which comes into contact with the outer terminal of the plug, when the plug is inserted, whereby the switch is electrically connected to the outer terminal of the coaxial connector via the outer terminal of the plug. The outer terminal of the coaxial connector is formed as a cylindrical shell. The switch terminal faces the outer terminal when the plug is not inserted. When the plug is inserted, the outer terminal of the plug is inserted between the switch terminal and the outer terminal of the coaxial connector.

Preferably, the switch terminal has the shape of a leaf spring. It is further preferable for the switch terminal to be positioned outside the cylindrical shell of the outer terminal.

BRIEF DESCRIPTION OF THE DRAWINGS

Other objects and features of the present invention will be apparent in the following detailed description of the preferred embodiment with reference to the attached drawings, wherein.

DETAILED DESCRIPTION OF THE PREFERRED EMBODIMENTS

The preferred embodiments of the present invention will now be described in detail with reference to the attached drawings.

Figure 1:
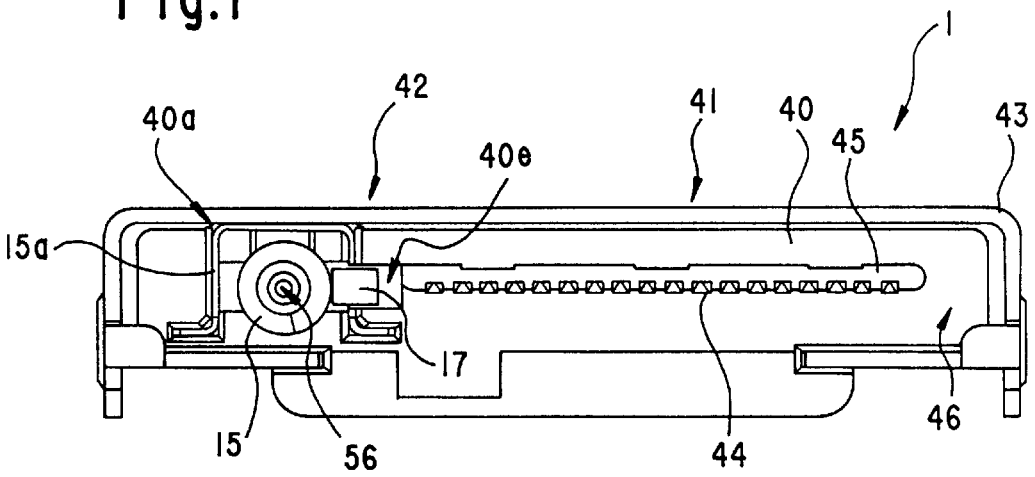
FIG. 1 is a front view of a coaxial connector with a switch according to a first embodiment of the present invention, wherein the coaxial connector with the switch is a receptacle being of an electrical-switching type.
Figure 2:
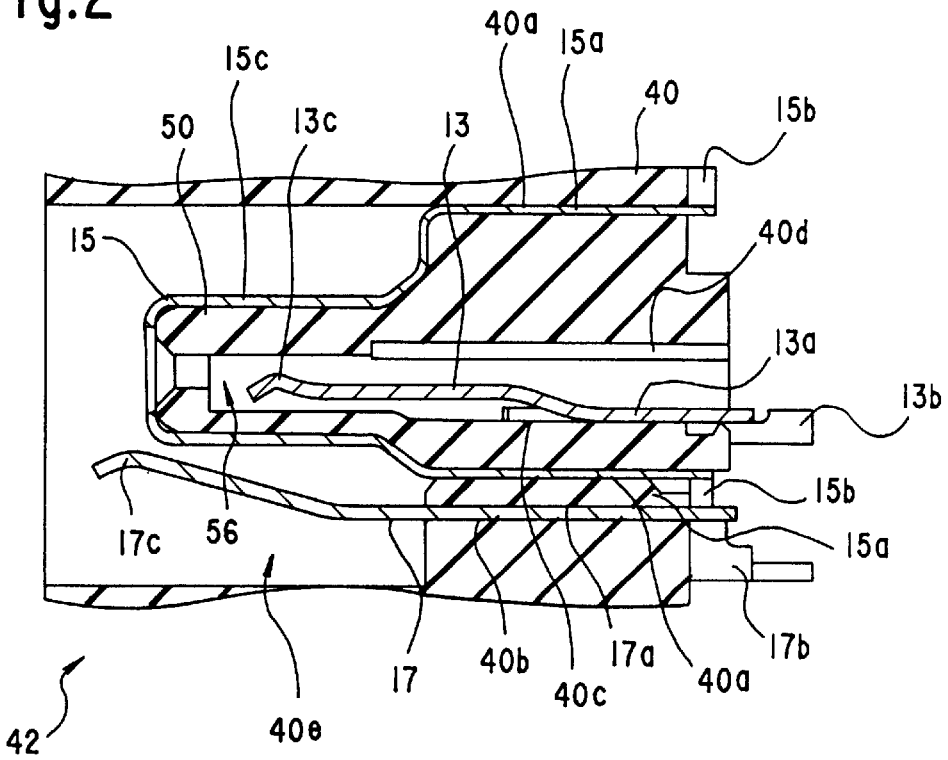
FIG. 2 is an enlarged vertical cross-sectional view of the coaxial connector with the switch shown in FIG. 1.
Figure 3:
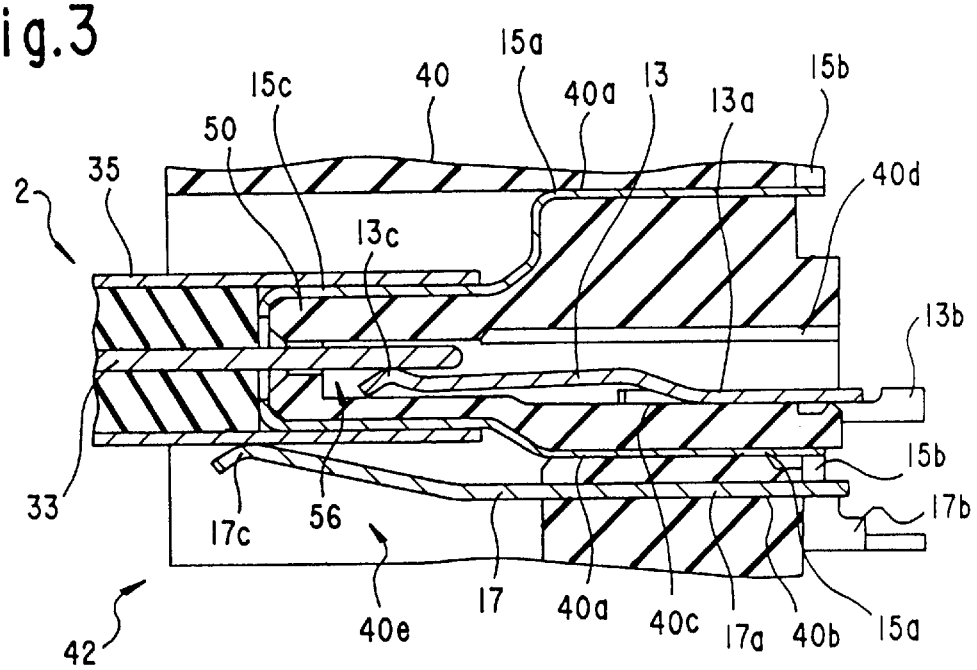
FIG. 3 is an enlarged vertical cross-sectional view of the coaxial connector with the switch, into which a plug is inserted.

FIGS. 1 through 3 illustrate the coaxial connector with a switch 42 according to a first embodiment of the present invention. The coaxial connector with a switch 42 is a receptacle being of an electrical switching type. The coaxial connector with a switch 42 has a central terminal 13, an outer terminal 15, and a switch terminal 17, which are all enclosed in an insulating housing 40.

The insulating housing 40 has a first groove 40*a* for receiving the outer terminal 15, a second groove 40*b* for receiving the switch terminal 17, a third groove 40*c* for holding the central terminal 13, and a fourth groove 40*d* for holding a sub-switch terminal 21, which will all be further described below. The first through fourth grooves are formed so as to be substantially parallel to the direction of inserting and removing the plug. The insulating housing 40 also has a recess 40*e*, which is a space to allow the contact tip 17*c* of the switch terminal 17 to elastically bend.

An insulating sleeve 50 projects within the insulating housing 40 toward the front opening of the housing 40 in order to guide a plug 2, when the plug 2 is inserted. A plug insertion hole 56 penetrates through the insulating sleeve 50, and it reaches the rear face of the insulating housing 40. The rear half of the plug insertion hole 56 is slightly wider than the front half. As shown in FIG. 2, the third groove 40*c* for receiving the base 13*a* of the central terminal 13 is formed along the inner surface of the wider part of the hole 56. Similarly, the fourth groove 40*d*, for receiving the base 21*a* of the sub-switch terminal 21, is formed along the inner surface of the wider part of the hole 56. Meanwhile, the first groove 40*a*, for receiving the frame 15*a* of the outer terminal 15 and securing it to the insulating housing 40, extends in a U-shape so as to surround the base of the insulating sleeve 50, as shown in FIG. 1.

The switch terminal 17 is a long leaf spring having a swelling contact point 17*c* on its tip, and it is placed so as to face the outer surface of the outer terminal 15. The switch terminal 17 is inserted into the second groove 40*b*. Claws (not shown), projecting from the side edges of the base 17*a* of the switch terminal 17, are pressed against the inner surface of the insulating housing 40 so that the switch terminal 17 will not come off of the insulating housing 40. A rear terminal 17*b* is at the rear end of the switch terminal 17. The rear terminal 17*b* projects backwardly from the rear face of the insulating housing 40. The contact point 17*c* on the tip of the switch terminal 17 is located very close to the outer terminal 15. When the plug 2 is inserted in the coaxial connector 42, the tip of the switch terminal 17 elastically bends in the recess 40*e* so that the contact point 17*c* comes into contact with the outer terminal 35 of the plug 2. The distance between the contact point 17*c* of the switch terminal 17 and the outer terminal 15 is set so as to be smaller than the thickness of the outer terminal 35 of the plug 2. Accordingly, the plug 2 is inserted so as to push the switch terminal 17 away from the outer terminal 15, whereby the switch terminal 17 is reliably electrically connected to the outer terminal 15 via the outer terminal 35 of the plug 2. The contact point 17*c* gently slants away from the outer terminal 15 so as to be apart from the outer terminal 15, as shown in FIG. 3, and the switch terminal 17 gradually bends outwardly as the outer terminal 35 of the plug 2 is inserted.

The central terminal 13 is a long leaf spring having a swelling contact point 13*c*, and it extends in the direction of inserting/removing the plug 2. The central terminal 13 is inserted into the third groove 40*c*. Claws (not shown), projecting from the side edges of the base 13*a* of the central terminal 13, are pressed against the inner surface of the insulating housing 40 so that the central terminal 13 will not come off from the insulating housing 40. A rear terminal 13*b* is at the rear end of the central terminal 13. The rear terminal 13*b* projects backwardly from the rear face of the insulating housing 40. The contact point 13*c*, on the tip of the central terminal 13, sticks out into the insertion path of the central terminal 33 of the plug 2. When the plug 2 is inserted in the coaxial connector 42, the contact point 13*c* of the central terminal 13 elastically bends, and the central terminal 13 comes into contact with the central terminal 33 of the plug 2. The contact point 13*c* is chevron-shaped having a gentle slope, and the central terminal 13 gradually bends, while keeping contact with the central terminal 33 of the plug 2, when the plug 2 is inserted.

The outer terminal 15 comprises a U-shaped frame 15*a*, a grounded cylindrical part 15*c* surrounding the insulating sleeve 50, and a pair of terminals 15*b* projecting backwardly from the frame 15*a*. The grounded cylindrical part 15*c* is electrically connected to the outer terminal 35 of the plug 2 in the plug insertion hole 56, when the plug 2 is inserted.

The rear terminals 13*b*, 17*b* and 15*b* of the central terminal 13, the switch terminal 17, and the outer terminal 15, projecting backwardly from the insulating housing 40, are positioned in the same plane as the bottom face of the insulating housing 40, and are connected to the corresponding patterns of the print board (not shown) by soldering.

Figure 7:
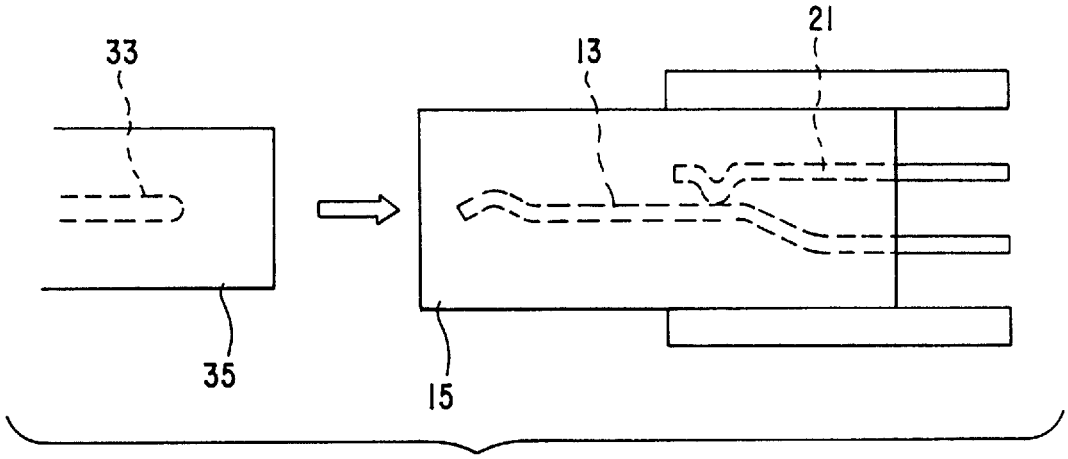
FIG. 7 illustrates a conventional coaxial connector with a switch, wherein the coaxial connector with the switch is a receptacle being of a mechanical switching type, and having a separate plug.

Although the receptacle (i.e., the coaxial connector with a switch) 42, according to this embodiment, is of an electrical switching type, it does not differ very much from the conventional mechanical-switching type coaxial connector shown in FIG. 7, either in shape or configuration, except for the leaf spring switch terminal 17 provided near the outer terminal. Accordingly, parts can be shared in common between the electrical switching type and the mechanical switching type coaxial connectors.

For example, if the coaxial connector with a switch is attached to a cellular phone of a electrical antenna-switching type, the central terminal 13 is connected to the transmitting/receiving circuit, the outer terminal 15 is grounded, and the switch terminal 17 is connected to the antenna-switching circuit. As compared with a conventional coaxial connector, only a leaf spring switch terminal 17 is added as an additional element, and the total size of the coaxial connector is almost the same as the conventional coaxial connector, which does not require extra space.

When connecting an external antenna to the cellular phone, the plug 2 of the external antenna is inserted into the receptacle (i.e., the coaxial connector with a switch) 42. As the plug 2 is inserted, the central terminal 13 comes into contact with the outer surface of the central terminal pin 33 of the plug 2, the outer terminal 15 gets into the cylindrical outer terminal 35 of the plug 2 which contacts the inner surface of the cylindrical outer terminal 35, and the switch terminal 17 comes into contact with the outer surface of the plug outer terminal 35. At this time, the switch terminal 17 is electrically connected to the outer terminal 15 via the plug outer terminal 35.

Then, the antenna switching circuit is activated. As a result, the transmitting/receiving circuit is disconnected from the internal antenna and, instead, it is connected to the external antennal via the central terminal 13. Because the cylindrical shell of the outer terminal 15 completely shields the central terminal 13, a satisfactory high-frequency performance can be achieved.

This receptacle 42 dedicated to an electrical switching type is often combined with a multipolar connector 41, and is used as a coaxial multipolar connector 1, as shown in FIG. 1.

The coaxial multipolar connector 1 comprises an insulating housing 40, a shield case 43, a multipolar connector 41, and an electrical switching type receptacle 42. The multipolar connector 41 receives the multipolar connector of the device to be connected (e.g., an external antenna), while the electrical switching type receptacle 42 receives the plug 2 of the connected device.

The multipolar connector 41 has a receiving recess 46 defined by the shield case 43 and the insulating housing 40.

A thin plate 45, which is integrated into the insulating housing 40, projects within the recess 46 toward the front opening of the connector 1. The multipolar connector terminals 44 are held by the insulating housing 40. One end of each of the multipolar connector terminals 44 is exposed along the projecting direction of the thin plate 45 (i.e., the direction perpendicular to the paper) on the bottom face of the thin plate 45. These exposed ends are to be connected with the multipolar connector terminals (not shown) of the external antenna. The other ends project backwardly from the rear face of the insulating housing 40, and are connected to the conductive part of the print board (not shown) by soldering.

In this specific example, the fourth groove 40*d* of the electrical switching receptacle 42 does not hold anything. However, a sub-switch terminal 21 may be inserted in the fourth groove 40*c*, as is necessary.

Figure 4:
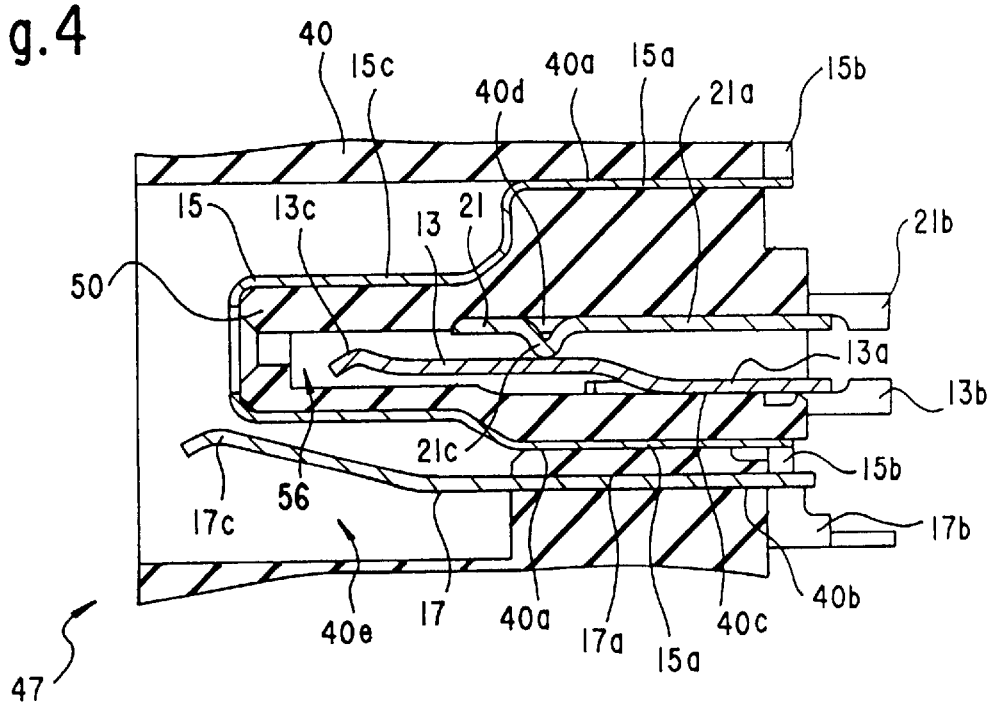
FIG. 4 is a cross-sectional view of the coaxial connector with the switch according to a second embodiment of the present invention, wherein the coaxial connector with the switch is a receptacle used for both electrical-switching type and mechanical-switching type coaxial connectors.
Figure 5:
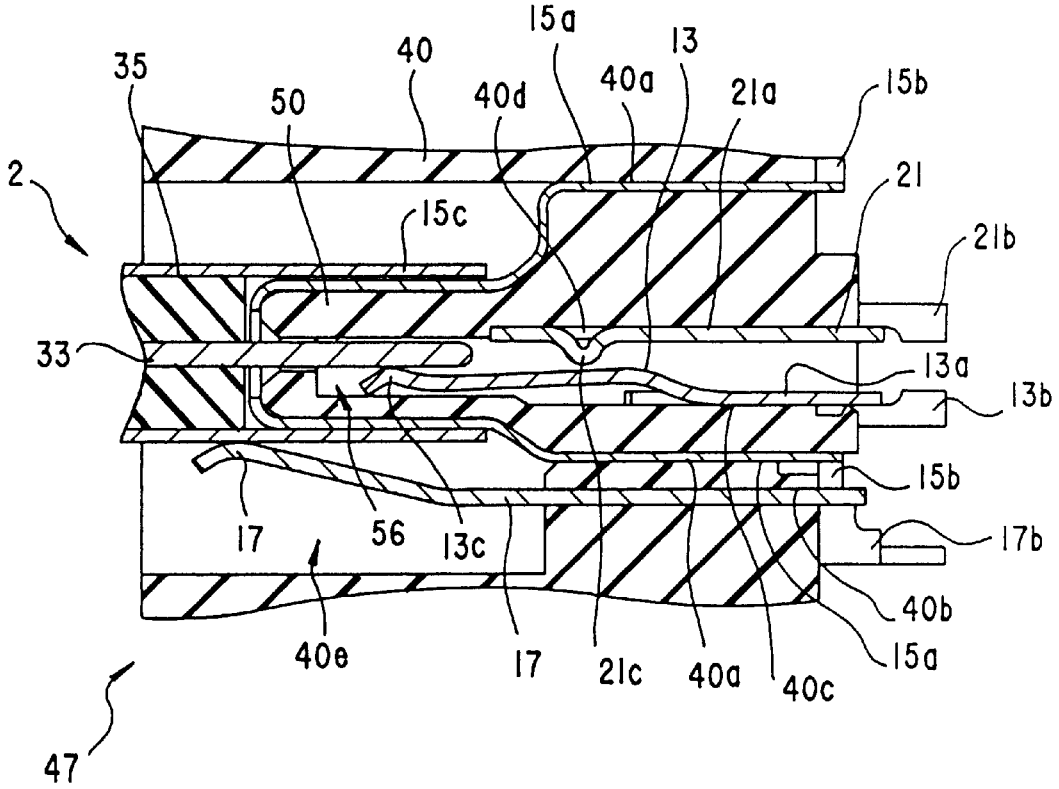
FIG. 5 is an enlarged vertical cross-sectional view of the coaxial connector with a switch shown in FIG. 4, into which a plug is inserted.
Figure 6:
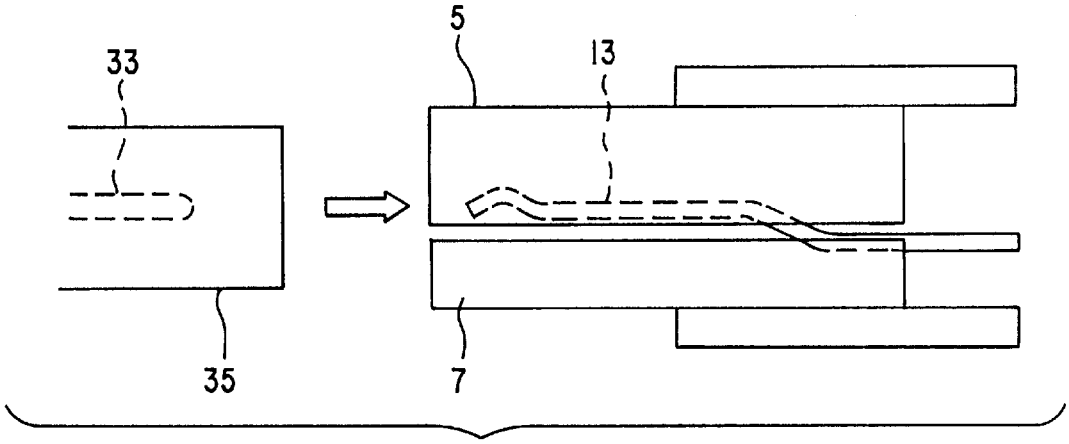
FIG. 6 illustrates a conventional coaxial connector with a switch, wherein the coaxial connector with the switch is a receptacle being of an electrical switching type, and having a separate plug.

FIGS. 4 and 5 illustrate the receptacle 47 having the sub-switch terminal 21 held in the fourth groove 40*c*, according to the second embodiment of the present invention. This receptacle 47 is used for both electrical switching type and mechanical switching type coaxial connectors. The sub-switch terminal 21 is a long leaf spring having a V-shaped contact point 21*c* on its tip, and it extends in the direction of inserting/removing the plug 2. The sub-switch terminal 21 contacts the inner surface of the outer terminal 15 and, at the same time, the contact point 21*c* contacts the middle part of the central terminal 13. Claws (not shown), projecting from the side edges of the base 21*a* of the sub-switch terminal 21, are pressed against the inner surface of the insulating housing 40 so that the sub-switch terminal 21 will not come off from the insulating housing 40. The rear end of the sub-switch terminal 21 is a rear terminal 21*b* which projects backwardly from the rear face of the insulating housing 40.

Explanation of the same elements as those in the first embodiment will be omitted here.

If the coaxial connector with a switch of the second embodiment is connected to a cellular phone of a mechanical antenna-switching type, the sub-switch terminal 21 is connected to the internal antenna side. In this state, the transmitting/receiving circuit is connected to the internal antenna via the central terminal 13 and the sub-switch terminal 21.

Then, the external antenna is connected to the cellular phone. As the connector (or plug) of the external antennal is inserted in the coaxial connector which has already been connected to the cellular phone, the central terminal 13 comes into contact with the outer surface of the central terminal pin 33 of the plug, and is pressed by the central terminal pin 33 in the direction of separation from the sub-switch terminal 21. Accordingly, the transmitting/receiving circuit is disconnected from the internal antenna and, instead, it is connected with the external antenna.

This receptacle 47, which is designed so as to fit both electrical and mechanical switching types of coaxial connectors, may be used in the coaxial multipolar connector 1 in place of the electrical switching type receptacle 42.

Although, in the first and second embodiments, the switch terminal is formed as a leaf spring, it may be formed as a cylindrical shell. In this case, the outer terminal and the switch terminal form a double cylinder. In addition, although in the first and second embodiments, the switch terminal is positioned outside the cylindrical shell of the outer terminal, it may be positioned inside the outer terminal.

The terms and expressions used in this specification are only explanatory, and not meant to be limiting. Such terms and expressions do not exclude equivalents of the features and the elements, and may imply many changes and substitutions within the spirit and scope of the present invention, which is defined by the appended claims.

What is claimed is:

1. A coaxial connector with a switch, to which a plug to be electrically connected is coupled in a removable fashion, the plug having a plug central terminal and a plug outer cylindrical terminal, said coaxial connector comprising:

a central terminal that is to be electrically connected with the plug central terminal when the plug is coupled;

an outer cylindrical terminal that is to be electrically connected with the plug outer cylindrical terminal when the plug is coupled, said outer cylindrical terminal surrounding said central terminal; and an elongated switch terminal having a contact portion, said elongated switch terminal being positioned along an outer peripheral surface of said outer cylindrical terminal such that said contact portion is located close to said outer peripheral surface to form a gap therebetween, said gap being smaller than a thickness of the plug outer cylindrical terminal, wherein the plug outer cylindrical terminal is fitted onto said outer cylindrical terminal, whereby said contact portion resiliently comes into contact with an outer peripheral surface of the plug outer cylindrical terminal and is electrically connected with said outer cylindrical terminal via the plug outer cylindrical terminal.

2. The coaxial connector with a switch according to claim 1, wherein said switch terminal is shaped as a leaf spring.

* * * * *